United States Patent [19]

Eickmann

[11] Patent Number: 4,562,796

[45] Date of Patent: Jan. 7, 1986

[54] RECIPROCATING PISTON ENGINE

[76] Inventor: Karl Eickmann, 2420 Isshiki, Hayama-machi, Kanagawa-ken, Japan

[21] Appl. No.: 348,633

[22] Filed: Feb. 16, 1982

Related U.S. Application Data

[62] Division of Ser. No. 807,975, Jun. 20, 1977, abandoned.

[51] Int. Cl.[4] ..... F02B 75/02

[52] U.S. Cl. ..... 123/65 BA; 123/65 VB; 123/41.65; 123/190 A

[58] Field of Search ..... 123/65 VB, 41.63, 41.76, 123/41.82, 190 E, 65 BA, 41.65, 41.82 R, 190 A, 190 R; 60/598, 605

[56] References Cited

U.S. PATENT DOCUMENTS

| | | | |
|---|---|---|---|
| 1,593,571 | 7/1926 | Curtis | 60/605 |
| 1,924,697 | 8/1933 | Shoemaker | 123/65 VB |
| 1,954,564 | 4/1934 | Edwards et al. | 123/65 VB |
| 2,189,106 | 2/1940 | Garve et al. | 123/65 VB |

FOREIGN PATENT DOCUMENTS

| | | | |
|---|---|---|---|
| 523905 | 5/1921 | France | 123/65 VB |
| 839963 | 4/1939 | France | 123/65 BA |
| 234850 | 2/1945 | Switzerland | 123/190 E |
| 407216 | 3/1934 | United Kingdom | 123/65 BA |
| 507974 | 6/1939 | United Kingdom | 123/41.76 |

*Primary Examiner*—Ira S. Lazarus
*Assistant Examiner*—R. S. Bailey

[57] ABSTRACT

A reciprocating combustion engine is improved by a cycle which applies outlet slots at the bottom of the cylinders, through which the exhaust gases exit to pass into a charger drive unit, while the charger drive unit drives a charger which delivers air or mixture over inlet valve means into the cylinder. The charging is also used to drive the exhaust gases out of the cylinder. Four cycle engines can thereby made up to two-stroke engines with super-charging. Outlet valves and heat on them as in typical four-stroke engines are spared. Flow areas into and out of the cylinder are increased and so is the power of the engine. A charger-arrangement provides a plurality of flow streams to super-charge the cylinders, to cool the valve head and to cool the valves. The head of the piston has a configuration relative to the valve head for preventing dead space and respective losses.

2 Claims, 12 Drawing Figures

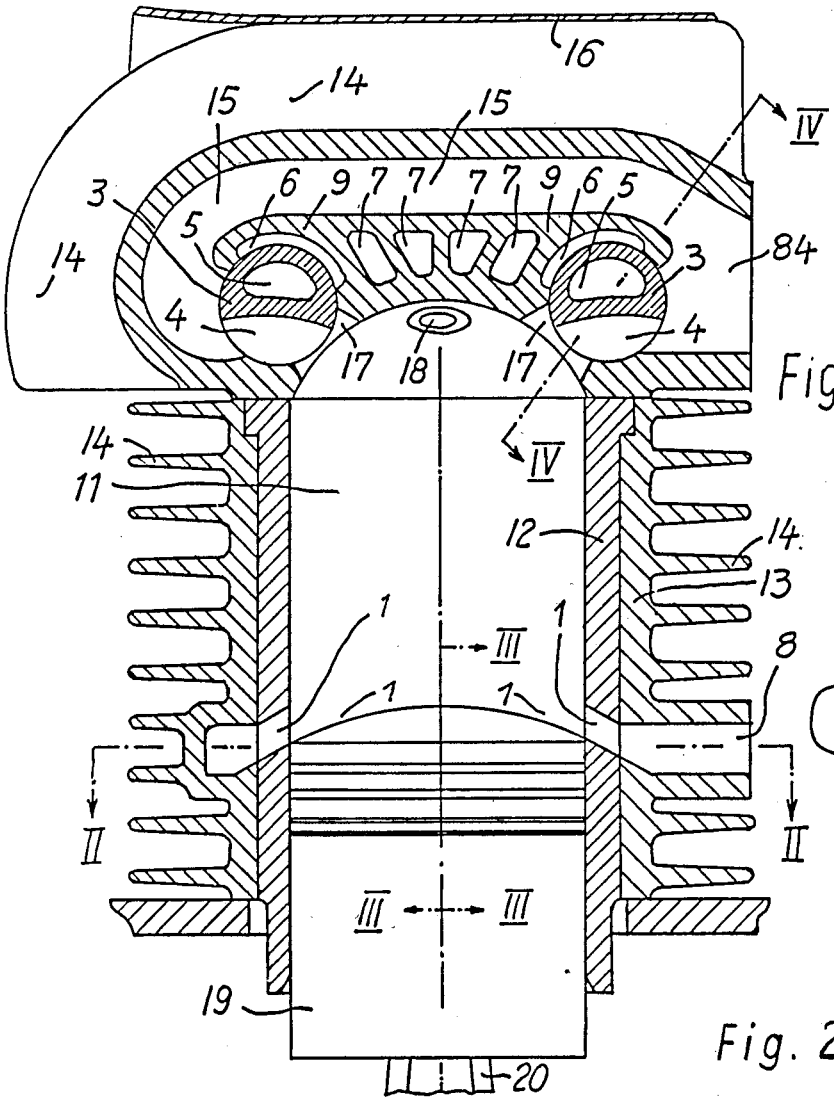
Fig. 1
Fig. 3
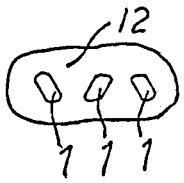
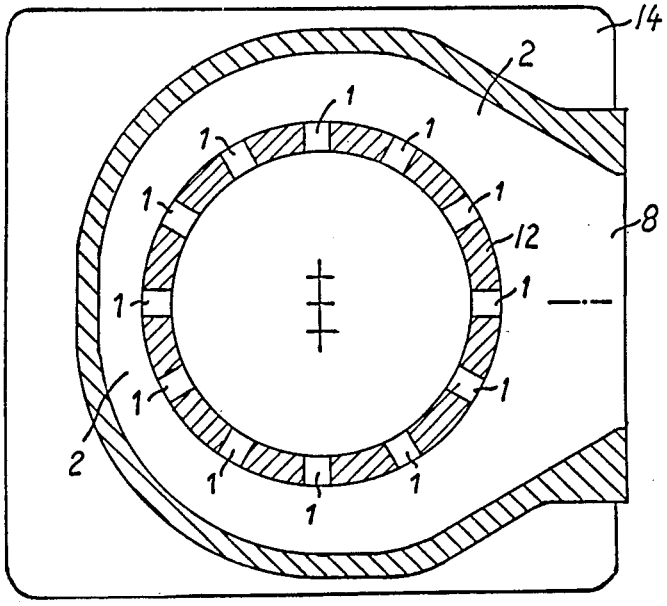
Fig. 2

RECIPROCATING PISTON ENGINE

REFERENCE TO A RELATED APPLICATION

This is a divisional application of my copending application, Ser. No. 807,975, which was filed on June 20th, 1977, now abandoned.

BACKGROUND OF THE INVENTION

Four-stroke and two-stroke combustion engines are widely used and each of them has features and also difficulties. The feature of the four-stroke engines is the good efficiency because the cylinder is cleaned out by force after each working stroke. Since at four strokes only one working stroke appears these engines have the disadvantage that they are of relatively small power per unit of weight.

The two-stroke engines have big power per unit of weight, because they have a working stroke at every two strokes. However, their efficiencies are bad, because the cylinders are not cleaned by force. Therefore, full filling with clean gas-air mixture is not assured.

A difficulty of both types of common engines is, that the cross-sectional ares for intake and exhaust are limited because there is not enough space for a maximum of inlet and exhaust area.

SUMMARY OF THE INVENTION IN THE ORIGINAL APPLICATION

The purpose of the invention in the original application is explained to at least partially overcome the mentioned difficulties of the known common combustion engines and at the same time to increase the reliability, the power per unit weight and under certain conditions also to increase the efficiency and/or life time of the engines.

one object is, to do away with the outlet valves and the exhaust pipes of the four stroke engines. Because the outlet valves are subjected to high heat, which reduces their life time and reliability.

A means of said object is, to provide outlet slots above the bottom position of the piston through the cylinder walls and also, to provide an exhaust collection chamber around the mentioned slots in the cylinder walls. A further object of the invention of the original application is, to provide the mentioned slots angularly spaced around the entire cylinder wall portion, whereby a maximum of outlet cross-sectional area is obtainned, while at the same design the slots can be short in the direction of the piston stroke. Thereby is also is another object, to increase the cross-sectional area of the outlet slots in combination with shortening of their height in order to obtain a maximum of closed working space in the cylinder.

Another object is, to set a drive unit for driving a loader, for example, a common super charger unit, directly before the inlet valve or a turbocharger directly onto the exhaust outlet without the need of piping around a half of the engine.

A further object of the original application is, to utilize an inlet valve of higher speed, more reliability and of bigger inlet area, while it is still another object, to set a plurality of inlet valves in order to increase the inlet cross-sectional area and/or in order to allow higher revolutions per minute of the engine.

Another object of the invention in the parental application is, to provide a space for double ignition plugs.

Another object of it is, to provide an improved cylinder head of simple configuration for easy machining, better cooling and prevention of the heated complicated portions of the cylinder head of former four stroke engines in the surrounding of the former outlet valves.

Still a further object of the invention of the parental application is, to provide at least two inlet streams, whereof one is a pure air stream for the purging of the cylinder of the exhaust gases and the other is an air-fuel mixture stream for filling of the cylinder with a combustible mixture.

The final object of the parental application is, to provide a turbocharger or other charger with two supply chambers for compressed gas. One thereof for clean, pure air, while the other may be for air-fuel mixture.

The invention(s) considered in the parental application were not fully aware of the details of the former art in the field. Therefore the parental application assumed, that the common four stroke engine can keep its major parts, but has to replace the cylinder block and the value head or inlet head to transform into the improved engine of the parental application. By setting the cylinder block and the inlet head together with the loading unit of the engine, the power of the common heretofore four-stroke engine would become 3.5 times by the invention of the parental application. Because the turbocharger would double the power generally, while the change of the engine from four-stroke of two-stroke would double the number of the working strokes. The power of the engine would be respectively increased. The efficiency of the four-stroke principle would be fully maintained, because the cylinder would be purged of exhaust gases by force. This was not the case in the commonly used two stroke engines. A little bit working volume would be lost, for example 10 percent, by the provision of the outlet slots, but the increase in power would be so very extensive, that the little loss of working volume would become acceptable or neglectible.

For higher efficiency the engine could run with a high air-fuel ratio "lambda," whereby the thermal and overall efficiency of the engine would increase, while at the same time the exhaust gases would remain cooler. The life time of the engine would thereby be extended. The engine of the parental invention is described as having a weight of approximately 0.4 kilogram per horsepower. Thereby the engine would be light enough to be adaptable to aircraft. It would give an extremely high power for take off or for vertical take off and landing with very little weight. Also, it would give a high efficiency later in level flight for saving fuel by the application of the high air-ratio and the high compression ratio. The cost of the engine would be considerably less than that of the common four stroke engine.

During the examination of the parental application Ser. No. 807,975, which is now abandoned, it was found, that a portion of the invention is at least partially known from the turbocharger two-stroke engine of U.S. Pat. No. 3,042,012 of Mr. Buchi. Also known are already some rotary valves and other valves, for example from U.S. Pat. No. 2,224,229; 1,839,791; 2,113,979; 4,016,840 or others. This present divisional application maintains the description of the embodiments of the parental application, but restricts the aims, objects and claims to the claimed content of the present divisional application.

SUMMARY OF THE INVENTION OF THIS PRESENT APPLICATION

The object of this present patent application is, to provide a powerful compact engine at low weight per horsepower.

One of the means to obtain the object of the invention is, to provide a piston head and a wall of the top of the cylinder, which may also be called "cylinder top wall" or "cylinder head wall", of relatively to each other suitable complementry configuration to permit a close nearing of the piston to the wall of the cylinder head to prevent dead space and thereby to increase the compression ratio in combination with the provision of plural rotary inlet valves in the cylinder head close to the top wall of the cylinder to permit short passages from the control ports of the valves to the cylinder(s) for reduction of dead space and thereby again for an increase of the compression ratio.

The next aim to obtain the object of the invention is, to set cooling spaces into the cylinder head close to the valves and to the common collection chamber and cooling passages through the rotary valves. Cooling fluid streams can therebey be passed through the cooling-passages and spaces to cool away the heat from the increased compression by the increased compression ratio and power of the engine.

BRIEF DESCRIPTION OF THE DRAWING

FIG. 1 is a longitudinal sectional view through an engine portion of the invention.

FIG. 2 is a cross-sectional view through FIG. 1 along II—II.

FIG. 3 is a view from inside of the cylinder along III—III.

DESCRIPTION OF THE PREFERRED EMBODIMENTS

Figure 4:
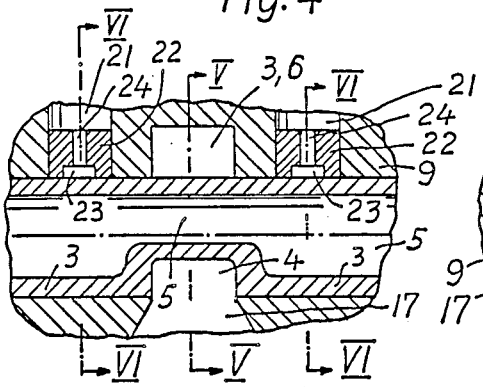
FIG. 4 is a partial sectional view through FIG. 1 along IV—IV.

Cylinder liners 12, which are also called the cylinder bushes form the cyliner 1 which is closed on top by the cylinder head 9. From the bottom of the there open cylinder 11 in the piston 19 moves upward and downward within cylinder 11. The piston 19 is driven by and drives the commonly used crankshaft over the conrod 20, which is the connecting rod between the crankshaft and the piston. Thus, the piston move up and down in the cylinder and thereby compresses and expands the cylinder space. This known cycle is used to compress air or air-fuel mixture, to ignite it, combust it and utilize the burning or burned gases to drive the piston in the expansion stroke, which gives the power to the engine. Thereafter the expanded gases are exhausting out from the cylinder. The words "up" and "down" are used in relation to FIG. 1, and so are the referentials mentioned in the above description of the common engine of the former art.

There were and are two major difficulties in those engines of the former art. In two-stroke engines the cylinder could not be cleaned by force. Therefore, old burned gases remained remained partially in the cylinder. That prevented clean burning of the new charge with best efficiency. The application of entrance of mixture under pre-compression in the crankcase of two-stroke engines made double sets of ports necessary in the cylinder walls. Since there is only limited space in a cylinder wall, the cross-sectional areas of the entrance and exit slots in two stroke engines could not become widely enlarged, as the enlargement of said cross-sectional areas is limited. Thus, the power and efficiency of the common two-stroke engines could not be increased without limit. The common four-stroke engine does not have the difficulties of cleaning of the cylinder from residue of burned gases, because it has a specific exhaust stroke, which sends the rest of burned gases of the prior working stroke out of the cylinder by use of force of the moving piston. However, in order to achieve this feature of good cleaning and loading of the cylinder the four stroke engine has to use inlet valves and outlet valves, which must be timely opened and closed by mechanical drive means. The exhaust or outlet valve is subjected to the heat of the hot outgoing gases. It operates in this heat.

The heat on the outlet valve and its surrounding parts and portions is therefore a main limitation to the existing four stroke engines. The requirement of four piston strokes or two revolutions, in order to achieve a single working or power stroke, limits the power of four stroke engines per unit of weight.

By this present invention these mentioned difficulties of four stroke-and of two stroke engines of today's common use will at least partially or almost completely by overcome.

For this purpose, the invention prevents the application of exhaust valves. Instead it provides the slots 1 through the cylinder wall 12. The slots 1 are set so, that they are slightly above the most downward position of the piston 19. It is preferred to provide an annular exhaust collection space 2 around the cylinder bush 12. The ports or slots 1 of the invention open and communicate to said exhaust collection space or exhaust collection chamber 2.

Collection chamber 2 may be made of increased cross-sectional area towards the exhaust port 8 in order to obtain equal velocities over the entire exhaust collection chamber 2. In accordance with the invention it is possible to space the slots 1 of the invention regularly at angular intervals over the whole 360 degrees of the cylinder wall. This is demonstrated in cross-sectional FIG. 2. Said FIG. 2 also demontrates the preferred enlargement of crosss-sectional area of collection chamber 2 towards the exhaust port 8.

Since the common two-stroke engine requires inlet slots and outlet slots, but the engine of this invention requires only outlet slots 1 in the bottom portion of the cylinder wall, it is clearly evident, that the exhaust slots 1 of the invention can be made substantially of twice the cross-sectional area of that of common two-stroke engines. Consequently in the engine of the invention it is substantially possible to exhaust twice as much burner gases, as in the common two-stroke engine.

The outlet slots 1 may be set in inclined angles as shown in FIG. 3 in order to have a good guide for the piston rings, so, that a piston rings will not break, when they move during the piston stroke over the slots 1.

Figure 12:
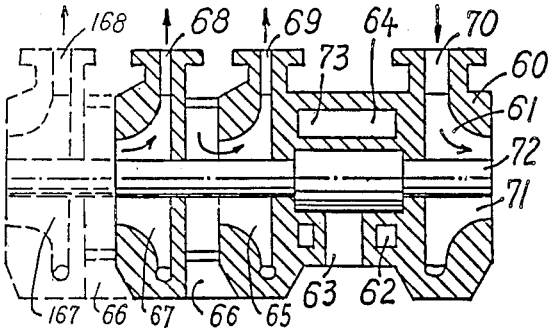
FIG. 12 is a longitudinal sectional view through a turbocharger of the invention to be applied to the engine of the invention.

According to the here described perferred embodiment of the Figures of the invention, the exhaust port 8 is connected to a gas motor or to a turbocharger turbine unit, for example, to entrance port 70 of FIG. 12. The gas-motor or turbine 71 drives a loader 69 which sucks in air or air-fuel mixture through entrance port 66 and supplies it as a compressed air or compressed mixture out of exit port 69 into entrance port 84 of the engine.

Instead of sending the exhaust gases through the gas motor or turbine 71, the exhaust gases can also be send through a muffler out into the atmosphere. In such case, however, a compressing unit or loader must be driven by other means. For example by the crankshaft or another rotary member of the engine or by an external power source.

The most economic and the most convenient one, also not at all cases the most inexpensive one, is a turbocharger of FIG. 12 or a turbocharger with only one compressor. It will be noted, that, a commonly known, the shaft 72 is borne in bearing 73 and connects the expansion rotor 71 with compression rotor 65 for revolving both in unison. Lubricating chamber 64 lubricates shaft 72 in bearing 73 and exit port 63 is provided for the leaking lubrication fluid.

According to the preferred embodiment, and also in accordance with the invention, at least one inlet valve means 3 is provided in the cylinder head 9 of the engine of the invention. This valve means 3 is operated in cycle with the moving piston 19 and timely synchronized to piston 19. That may be done by mechanical means, for example, by common drive means, like, gear, chain, belt and like. Inlet valve means 3 provides the opening and closing of inlet passage 4. Commonly there is also an inlet fluid collection or supply chamber before the inlet passage 4. That is however not shown in the drawing because it is commonly incorporated into the inlet passage from the loader to the inlet passage.

When the piston 19 moves downward and thereby opens the outlet slots 1 of the invention, the compressed air or air-fuel mixture enters through the open entrance passage 4 into the clinder 11 and thereby presses the remainder of the old burned gases of former working stroke through the exit slots 1 out of the cylinder. This continues until the later upwards moving piston 19 closes the slots 1 of the invention. After enough new air or air-fuel mixture will have filled the cylinder 11, the entrance passage 4 closes and the gas in the cylinder becomes compressed during the further compression stroke or upward movement of piston 19.

When the piston is near to its uppermost position, either the air-fuel mixture becomes ignited by spark plugs 18 or fuel becomes injected into the hot air in the cylinder 11 by a fuel injection nozzle 18. Spark plug and fuel injection nozzle have equal referentials 18, because in accordance with the invention both are applicable alternatives. The engine can run in Otto-type ignition of air-fuel mixture or in Diesel type fuel injection into compressed hot air in the cylinder. Depending on the compression ratio and other design consideration, the user of the engine of the invention selects either a ignition means 18 in the cylinder head or a fuel injection means 18 in the cylinder head 9.

The elimination of the exhaust valve in the cylinder head provides in accordance with this invention, much space in the cylinder head to set double ignition plugs 18 or to set double injection nozzles 18 into the cylinder head.

It also provides much space for cooling ribs or other cooling means. These provisions of the invention provide a higher reliability and a longer life to the engine.

The embodiment of the inlet valve shown in FIG. 1 is in detail demonstrated in FIGS. 1 and 4 to 6. It is rotatably borne in the cylinder head 9 or thereon. The rotation is provided by commonly known mechanic at means, as chains, gear, belt and coupled into unison with the crankshaft or another moving member of the engine.

At the right time, when the piston is near its bottommost position and the slots 1 are opening, the inlet passage 4 opens the entrance from entrance port 84 into cylinder 11. The air or air fuel mixture is then forced by the loader, compressor or turbo compressor 69 into cylinder 11, until the said cylinder is free of exhaust gases and completely filled with new air or mixture. Thereafter by revolving further, the closing portion of the valve 3 closes the cylinder 11. Said closing portion of valve 3 is demonstrated in FIG. 5. The open position is demonstrated in FIGS. 1 and 4. Thus, FIG. 5 shows the valve 3 in a turned position.

Valve 3 may be a rotating shaft. It may be hollow and be provided with cooling passage 5 for cooling of the valve 3.

Figure 5:
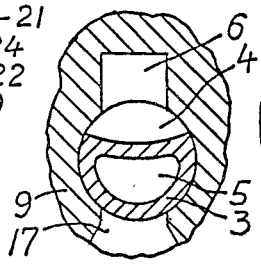
FIG. 5 is a cross-sectional view through FIG. 4 along V—V.
Figure 6:
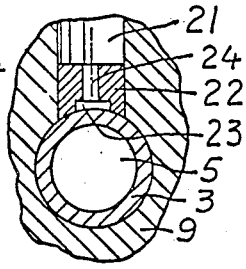
FIG. 6 is a cross-sectional view through FIG. 4 along VI—VI.

FIGS. 4 and 6 demonstrate, how it can be assured, that a closing position the valve 3 is all times closely sealingly pressed against the respective portion of the cylinder head 9. For that purpose the pressure chambers 21 may be provided in the cylinder head 9 or a respective bearing member. Thrust bodies 24 are axially moveable in said pressure chambers 21. Passage means 24 may extend through thrust body 22 into a fluid pocket or pockets 23. During operation fluid is led into thrust chambers 21. Thrust chambers 21 may be located diametrically to the entrance flow passage 17 or laterally distanced therefrom, for example, as shown in FIG. 4. The fluid, let into the thrust chambers 21 may be lubrication oil or gas. The pressure may be supplied by an external pumping source or pressure source or by communication with the fluid pressure in the cylinder 11. The cross-sectional area of thrust body 22 or of all of them in the sum, is so calculated, that the force excerted by it against the valve 3 is all times oppositionally directed against the pressure in cylinder 11 and in flow passage 17 but all times a little bit higher than the force out of passage 17 against the valve 3. Thus, under all conditions the valve body remains pressed against the sealing surface portion of the valve head 9 and thereby the valve 3 closes the cylinder perfectly, when revolved into into its closing position as shown in FIG. 5.

Figure 7:
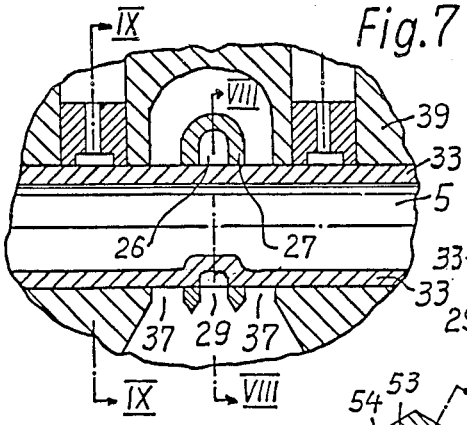
FIG. 7 is an alternative to FIG. 4 in equal view.
Figure 8:
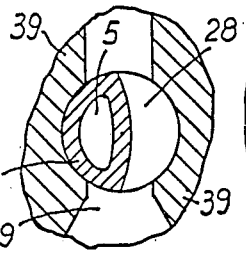
FIG. 8 is a cross-sectional view through FIG. 7 along VII
Figure 9:
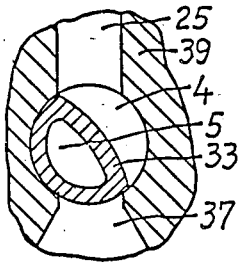
FIG. 9 is a cross-sectional view through FIG. 7 along IX—IX.

In FIGS. 7 to 9 an alternative to valve 3 of FIGS. 1, 4, 5, 6 is demonstrated. In FIGS. 7 to 9 the cylinder head has two or three, in short a plurality of inlet and flow ports or passages. Namely inlet ports 25 and 26 and passages 29 and 37. One port and one of the passages is for inlet of pure compressed air. The other may be for inlet of fuel-air mixture. Respectively the valve 33 has two different inlet openings, namely 28 and 4.

FIG. 8 shows the inlet opening 28 in the opened position. Fresh compressed air flows for example from a loader air compressor 67 of FIG. 12 through exit port 68 of FIG. 12 into inlet port 26 of FIG. 8, therefrom through valve inlet opening 28 into flow passage 29 and therefrom into the cylinder 11. It presses all residue of old burned gases from the earlier working stroke out of cylinder 11. When this procedure is completed, the valve 33 has in the meanwhile continued its revolving. Port 28 now closes and inlet opening 4 of FIG 9 begins to open. The fluid-fuel mixture now flows, for example, from the respective loader or from fuel-mixture compressor 65 of FIG. 12 through exit port 69 into the entrance port 25 of FIG. 9. Therefrom the air fuel mixture flows through the valve opening 4 into the flow passage 37 and therefrom into the cylinder 11. As soon as the cylinder is filled with the fuel-air mixture, the outlet slots 1 are closed by the piston 19. The piston then compresses the mixture in the cylinder, because at about the same time, when the slots 1 close, the inlet opening 4 closes also, because the valve 33 continues the rotation. Thus, when the outlet slots 1 are closed, the inlet valve openings 28 and 4 are also closed. The piston now continues to do its compression stroke, until about at its uppermost position the ignition plug or plugs fire, the mixture burns and thereafter the expansion or working stroke occures, when the piston 19 moves downward again, until the oulet slots 1 open and the expanded gases exhaust outwards through the slots 1 and the collection chamber 2. The cycle is now completed.

The engine, thus has given one complete working cycle at a single revolution of the crankshaft. The power is thereby substantially doubled compared to the four stroke engine. It is not exactly doubled, because the slots 1 of the invention take a portion of the compression and expansion stroke away compared to four stroke engines. The slots 1 of the invention extend however only over a small portion of the piston stroke, for example 10 to 20 percent. Thus, the power of the engine increases to about 1.6 to 1.9 over the power of the common four stroke engine.

Since it is one object of the invention, to eliminate the exhaust valve of the common four stroke engine, the invention obtained free space in the cylinder head, which can, in accordance with the invention, be utilize to set a second inlet valve into the cylinder head. Such possibility is demonstrated in FIG. 1. On the left side of cylinder head 9 we see the second inlet valve 3 with second inlet opening 4 in valve 3. Overflow passage 15 communicates inlet port 84 not only to inlet opening 4 of the right inlet valve 3, but also to the second, the left inlet valve 3 and thereby to both openings 4 of both valve 3.

By this provision of the invention the cross sectional area for inlet flow is doubled compared to common four stroke engines. Thereby the engines can run at higher rpm, because almost double the amount of air or fuel-air mixture can now be led into the cylinder 11 in accordance with the invention, namely 1.6 to 1.9 times more than in the common four stroke engine.

Thus, the power is not only almost doubled compared to four stroke engines by providing double working strokes per an equal crankshaft revolution, but the power is again almost doubled by the provision of double inlet area of the invention. Thus, the engine can revolve with higher rpm than the common four stroke engine. In short, the power of the engine of the invention can become increased almost 3.5 times over the power of a common four stroke engine of equal size. At the same time the weight is reduced, because the rotary valves 3 need less weight, than the common cam-shaft assembly with axially moving valves of common four stroke engines.

Cover 16 provides a good guide for ram air through the spaces between ribs 15 of the valve head for cooling the valve head effectively when the engine moves foreward in a car, motorbike, in an aircraft or another vehicle. Cylinder ribs 14 are common cooling ribs. Instead of air-cooling as shown in the figures, the engine can also use water cooling.

Instead of providing rotary valve 3 in the cylinder head it is also possible to leave the common inlet valve in the cylinder head. In such case only the cam shaft has to be modified, in order to provide one opening of the inlet valve at one rotation of the crankshaft. This can also be achieved by providing the common camshaft with equal revolution as the crankshaft. The crankshaft in an engine of common type revolves only with half of the rpm of the crankshaft. Thus, just by changing the drive gear, for example sprocket, a common four stroke engine can be converted into an engine of the invention. Just the rocker arms for driving the outlet valves are taken off. Then the common outlet valve remains closed at all times. The cylinder block of the common engine becomes replaced by one of the invention, and the common four stroke engine has obtained the increased power by these means of the invention. Naturally the charger, for example, 69, has to be added. Thus, by the means of the invention, the take off power of common aircraft engines can be multiplied by the small modifications, as described above.

The above at hand of the sample of FIGS. 7 to 9 described timely distanced supply of air and later of fuel-air mixture into cylinder 11 is done in order to prevent any escape of fuel-air mixture through the oulet slots 1 of the invention. This provision overcomes the trouble of common two stroke engines, where fuel-air mixture can timewise escape from the outlet slots. Thus, the invention prevents the efficiency losses of common two-stroke engines. Instead of sending the different gases timely distanced into the cylinder, it would also be possible to send the air to one of both inlet valve 3 into cylinder 11 of FIG. 1 and the air mixture therafter through the other inlet valve 3 of FIG. 3. In such case separated inlet ports have to be provided in the valve head. For example one on the right side, as 84 in FIG. 1 and another on the left side.

To provide two different flows of gases, for example, one flow of pure air and another flow of air-fuel mixture, the turbocharger of FIG. 12 of the invention differs from the common turbocharger insofar as shaft 72 is elongated, a second compressor rotor 67 is mounted on the elongated shaft and a respective additional housing portion exit port 68 is provided. The described means prevent escape of air-fuel mixture through the exhaust ports 1 of the invention and thereby prevent losses of fuel and increase or provide a good efficiency and fuel economy of the invention.

A further difficulty of common four stroke engines is, that the exhaust pipes go in forward direction of the engine. That prevents a good cooling air flow to the engine's cylinders and valve head and also it heats the cooling air up before the cooling air reaches the ribs, which it should cool. The exhaust collection chamber 2 of the invention exhausts all hot exhaust gases to the end of the engine directly into entrance port 70 of the turbocharger of FIG. 12 or of any common turbocharger. This spares the heretofore used long pipes from the front of the engine to the turbocharger in the back of the engine of motorcycles and other vehicles. But in addition, since the forward hot exhaust pipes are prevented by this this invention, there is now nothing left, which would disturb the flow of good cooling cool air to the cooling ribs of the engine. Thus, the cooling of the engine is effectively increased by the provision of the means of this invention.

A further feature of the engine of the invention is, that at times of required high power, the engine can run with 3.5 times of the power of the common four stroke engine at same weight of the engine or at even little less weight.

But, that is not all, because the engine of the invention may over longer time operate with more fuel economy than the common four stroke engine. For example, a verticl take off aircraft requires a very high power at vertical flight, like take off and landing. But at forward flight it uses only a fraction of the take off power. At such foreward flight are aircraft will fly much longer than at the short time of vertical take off or landing. The long forward flight, thus, desires fuel economy at our times of shortness of fuel. This can be obtained by the means of the invention. For example by running the engine with a high over air ratio lambda. Common engines run with lambda=about 1, which means with so much fuel, that it just burnes in the air. The fuel is just the stochimetric value needed to burn the respective amount of fuel in the respective amount of air. But in fuel economic operation, a high over air ratio, for example two or mor times, than lambda=1 the thermal efficiency of the engine increases. That results in less power, but inless fuel consumption per used HP too. Such fuel economy is highly desired. In the common four stroke engine it was difficult to achieve this desired fuel economy, because the benefit in thermal efficiency would be eaten away again by the bigger friction losses at only one working stroke at two crankshaft revolutions. But, the engine of the invention has only two strokes per one power stroke. Thus, it has only half of the friction in valves, piston on cylinder wall, crankshaft bearings and like. The sum of friction per power stroke reduced, the engine obtains the possibility of using a higher air ratio lambda, because much less friction of the engine per power stroke takes less friction losses away from the power stroke, than a conventional four stroke engine does. Thus, the engine obtains at higher air ratio lambda a better total efficiency than the common four stroke engine.

Figure 10:
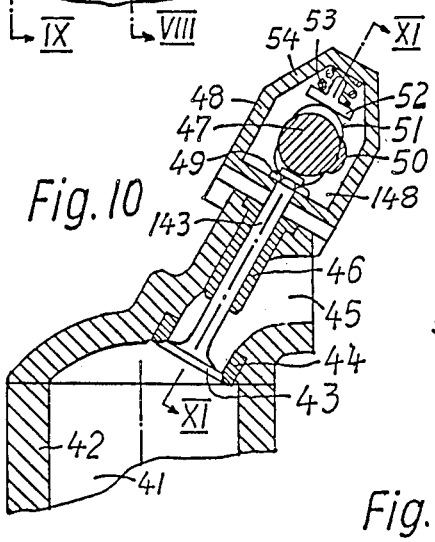
FIG. 10 is a longitudinal sectional view through another embodiment of the invention.
Figure 11:
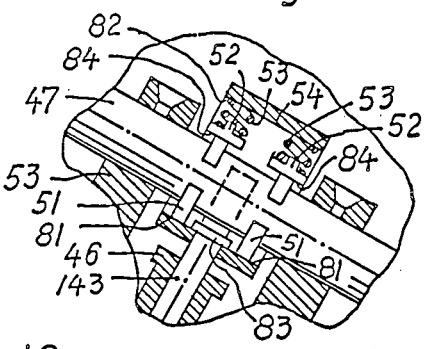
FIG. 11 is a cross-sectional view through FIG. 10 along XI—XI.

In FIGS. 10 and 11 an improved valve is shown, which can be used in the engine of this invention, but also in any common four stroke combustion engine.

The commonly used valves in common four stroke engines have the difficulty, that the valve is lifted against a strong spring set. The strong spring set closes the valves, at those times, when the valve is required to be closed and when not any action to open the valve by force is acting. The valve opener, for example, cam shaft or cam shaft and rocker or bar, open the valve against the spring set in the full stroke of the respective valve. Thus, the common spring set of the valve in the common engine experiences a compression in the full extent of the valve stroke. This is a considerable compression length for a spring. It reduces the life time of the spring set and requires strong and long springs of best material and manufacturing. Said difficulty can be overcome by the means of FIGS. 10 and 11 of the invention.

The valve 43 is, as common in present day four stroke engines, borne on seat 44, when closed. It seals againt the seal seat insert 44. From the back of the valve disc 43 extends in the known style the valve shaft 143 and said shaft 143 is guided in the guide bush 46 for the axial movement of the valve 43-143. The valve shaft 143 extends through the inlet port 45 in the known way. For opening of the valve a rocker or cam shaft pushes the valve 43-143 in the direction towards the cylinder, whereby the valve disc 43 opens away from the valve insert seat 44. Insofar the valve is common in four stroke engines and well known.

According to the invention, however, the valve shaft 143 is much shorter, than in the common engine. That is, because according to this embodiment of the invention, the common spring is eliminated, since it was a most loaded and most endangered part of the common engine. Instead of the heretofore common spring, only the holder bottom of holder 48 is fastened to the valve stem or valve shaft by holding retainer 49. The holder 48 may be hollow in order to make the insertion of a valve rocker or the insertion of a cam shaft through it possible. In the FIGS 10 and 11 the camshaft 47 is extended through the hollow holder 48. The camshaft 47 has the generally known knock body portion 50, which, when the camshaft 47 is turned, thrust agains the valve end and forces it downward for opening from valve seat body 44. Such opening procedure for opening the valve is generally used.

However, the commonly used valve stem or valve shaft 143 is much longer than the valve of the invention because it includes a complete spring set between bush 46 and holder retainer 49. But in the invention, the distance from the valve guide bush 46 to the holding retainer means 49 is only very short. In fact, only slightly longer, than the valve opening stroke is. According to the invention, the holder 48 includes a top portion 54 opposite to the bottom portion of it. On top of the camshaft 47 or on top of a respective rocker arm is a small spring set 53 provided with a guide slide portion 52. Instead of one, there can be a pair or a plurality of these members as demonstrated in FIG. 11. The small spring set 53 of the invention is borne on one end the the slide guide member 52 and on the other end by the upper portion 54 of the holder 48. It is preferred to set the cam shaft 47 sidewards of the valve stem 143 into bearings 55 wherein the cam shaft 47 can revolve. In the embodiment of FIGS. 10 and 11 there are two sets of small springs 53 and also two sets of slide members 52. Each one to each spring 53. The slide members 52 are pressed against the outer surface of the cam shaft by springs 53. The cam shaft of this embodiment of the FIGS. 10 and 11 has laterally distanced a little from the main knock known portion or thrust portion 50 are rather oppositionally located upwards thrust body configurations 51 provided on the cam shaft 47. They extend over a much wider angle around the camshaft 47 than the downward thrust-portion 50 does. The said upward thrust configuration body portions 50 lift the valve 43-143 upwards to close it on valve seat 44 by pressing against the upper portion 54 of holder 48. Diametrically opposite to the downward thrust-portion 50 are no upward thrust portions 51. Thus, the upward and downward thrust portions 50 and 51 co-operate together inside the hollow holding member 48 to move the valve 43, 143 upwards to close and downward to open in relation to the rotation of the cam shaft of the crankshaft or move of the piston of the engine. If the inner configuration of holder 48 is exactly machined to match the radii of thrust portions 50 and 51 of the camshaft, there would not be any need for spring sets 53. The crankshaft would just rotate around in the hollow holder 48 and thereby move the valve 43 up and down for open and close, as desired in the engine. In order, however, to allow a small machining tolerance in the inner configuration of the holder 48, the valve set including the slide portion, namely 53 and 52, can be incorporated into the interior of the holder 48.

It is, thus, left up to the designer's choice, either to use spring sets 53 and slide bodies 52 inside the hollow holder 48 or likewise to broach the inner configuration of the holder 48 accurately and let the thrust configurations 50 and 51 slide along the respective inner face portions of the bottom and of the top of holder 48.

When the spring set (s) 53,52 is (are) provided, a good closing of the valve disc 43 on the valve seat 44 is assured by the force of said spring set 53,52. The spring set 53 does almost not any expansion or contraction work in this invention. It is almost stationary in rest respective to its own compression and expansion. It only maintains a force aganist the valve 43-143. It keeps it close on the seat 44 and it moves together with the entire valve up and down during operation of the valve. The spring deflection is therefore so very small, that the life time of the spring is increased many times compared to the valve springs of common four stroke engines and also the spring is much shorter and of less weight, than the springs of the common engines are.

Thus, the reduction of spring deflection, the reduction of weight and the increase reliability of the structure provides a valve means of higher reliability and of higher life, than the common valves of four stroke engines of today. Therefore, the valve assembly of the embodiment of FIGS. 10 and 11 of the invention does not only increase the life time and reliability of the valve of the invention, but can equally increase the life, speed and reliability of valves in common four stroke engines, if applied in them as inlet or outlet valve means.

Since the valve of said Figures is shorter and the entire valve-spring set weight is less than in the common four stroke engine, the valve set of the invention can operate with higher cycles, which means with higher rpm and can thereby increase the power of engines whereto it will be applied and at same time slightly even reduce the weight of such engines.

The Figures demonstrate only samples and embodiments of the invention. Any suitable modification falls within the scope of the invention, provided that it serves equal purposes as described in this invention. The invention may not only be applied to crankshaft piston engines but also to free piston engines or to hydraulically operated piston engines, for example as in my U.S. Pat. Nos. 2,260,213 or 3,269,321.

Referring now to FIG. 1 again, it should be noted, that it is of extreme importance for the power of the engine to obtain a high compression ratio. This is obtained in FIG. 1 by the arrangement of the combination of the configuration of the top face of the piston and the top wall or face of the cylinder together with short passages 17 between the inlet valve(s) and the cylinder head wall. The Figure shows a top wall or top wall face 100 of a hollow configuration, for example, in the Figure in the configuration of a hollow part of a ball or of a part of a cylinder. The top wall may be formed by a first radius 102 around a first center 103. The piston shows in the Figure a piston top or top face 101 of a configuration which is substantially complementary to the configuration of the cylinder top wall 100. The piston top 101 may be formed by a second radius 104 around a second center 105. In the ideal case of infinitive high compression ratio the radii would be equal and the mentioned second center of the piston top would obtain the same position as the first center of the cylinder top wall permanently has. The dead space in the cylinder would then be zero and the compression would be infinitvely high. Since such ideal solution is not practically obtainable, the second center will in practical application come close to less than a centimeter or millimeter to the first center. In practical application the mentioned first and second radii should be equal or almost equal in order to obtain a high compression ratio and thereby a high power of the engine. The Figure further demonstrates, that the cylinder head is of such configuration, that the rotary valve 3 are very close to the cylinder top wall 100. Thereby the passages 17 are becoming very short and they thereby prevent a large dead space. This again is in favor of a high compression ratio.

Since and high compression ratio and power of the so obtained engine produces a great heat, it is suitable to mount a cooling flow provider to the engine for passing cooling fluid flows through the cooling passages 5 in the rotary valves through the cooling spaces 7 in the cylinder head. The simplest method to provide such cooling flows is, to use the multiple compressor flow turbocharger of FIG. 12. The outlet 69 may then supply the compressed air flow through the ports 4 of the valves 3 into the cylinder of the engine. The outlet 68 of the turbocharger may then lead a separated cooling flow through the mentioned passages 5 and spaces 7 of the valves and of the cylinder head. A still more ideal solution is, to set three compressor stages onto the common shaft 72 of the turbocharger. The second outlet 68 would then supply and force a separated air flow as cooling flow through the passages 5 of the rotary valves. The third outlet (168 from a third compressor 167, shown by dotted lines in FIG. 12,) would then lead a further separated air-stream cooling flow to and through the cooling spaces 7 of the valve head or cylinder head 9. The outlets of the turbocharger would have to become respectively connected by respective passage means to the mentioned spaces 7 and passages 5. With the described provisions the engine obtains the desired high power at little weight.

The engine of this invention is then defined in a concise description for example, as follows:

(A) A reciprocating combustion engine including substantially a structure of cylinder 11,12, a piston 19 reciprocating in said cylinder, a top for closing one end of said cylinder; inlet means 3 and outlet means 1 extending to and from said cylinder for the intake of a combustible gas charge and the expellation of burned exhaust gases, ignition means for the ignition of said gas charge, cooling means 14,7 on said cylinder and on said top, a turbine 61 of a turbocharger 60 communicated to said outlet means and a compressor of said turbocharger communicated to said inlet means said outlet means formed by slots 1 in the bottom portion of said cylinder and said inlet means are applied in said top, said gas charge including air, said air being pressed through said inlet means into said cylinder by said compressor, at least one second cylinder fastened relatively to said cylinder, a second piston reciproating in said second cylinder, a common drive means attached to said piston and said second piston for driving said pistons to compression strokes in said cylinders at alternating times, said second cylinder including second outlet means communicated also to said turbine, said top includes second inlet means communicating with said second cylinder and said compressor, wherein a common collection chamber 15 is provided in said top, communicated to said inlet means of said cylinders and to said compressor and attached to said cooling means of said top for the cooling of said air, when said exhaust gases drive said turbine and said compressor presses at least said air through said common collection chamber and said inlet means into the said cylinders, and for, wherein said cylinder forms a top wall 100 of a partially hollow configuration, while said piston forms a piston top 101 of substantially complementary configuration relatively to said top wall to at least and temporarily enter into said configuration to move close towards said top wall and close to said inlet means to obtain a high ratio of compression for a high efficiency and high power operation of said engine.

or; as;

(B) The engine of A, wherein said inlet means consists of two rotary valves 3 which are located in said cylinder head to revolve therein in unison, wherein passage means 17 extend from said inlet valves to said cylinder, wherein said passages means are short and said inlet valves are close to said cylinders to prevent dead space, and, wherein said passage means port into and through said top wall of said cylinder.

(C) The engine of B, wherein said rotary valves contain cooling passages 5 and flow control ports 4, wherein cooling spaces 7 are provided close to said common collection chamber and close to the outer walls of said rotary valves, and, wherein cooling fluid streams are passed through said cooling passages and through said cooling spaces.

(D) The engine of C, wherein said turbocharger contains at least two compressor spaces 65, 67 and at least two compressor outlets, 68, 69 wherein one of said outlets is led to said cylinder(s) and at least one of said outlets is communicated to said cooling passages and to said cooling spaces to pass at least one of the flows of said outlets to and through said cylinder(s) and at least another of the flows of said outlets to and through said cooling passages and cooling spaces.

(E) The engine of D, wherein said turbocharger has three separated compression chambers 65,67,167 with compressor blades therein driven in unison by said turbine, while each of said compression chambers has a separated outlet 68,69,168, wherein one of said outlets supplies air to said cylinder(s), the second of said outlets supplies air to and through said cooling passages of said valve(s) and, wherein the third of said outlets supplies air to and through said cooling chambers in said cylinder head.

I claim:

1. A reciprocating combustion engine including substantially a structure of a cylinder, a piston recirprocating in said cylinder, a top for closing one end of said cylinder; inlet means and outlet means extending to and from said cylinder for the intake of combustible gas charge and the expellation of burned exhaust gases, ignition means for the ignition of said gas charge, cooling means applied on said cylinder and on said top, a turbine of a turbocharger communicated to said outlet means and a compressor of said turbo charger communicated to said inlet means, said outlet means formed by slots in the bottom portion of said cylinder and said inlet means are applied in said top, said gas charge including air, said air being pressed through said inlet means into said cylinder by said compressor, at least one second cylinder fastened relatively to said cylinder, a second piston reciprocating in said second cylinder, a common drive means attached to said piston and said second piston for driving said pistons to compression strokes in said cylinders at alternating times, said second cylinder including second outlet means communicated also to said turbine, said top includes second inlet means communicating with said second cylinder and said compressor, wherein a common collection chamber is provided in said top, communicated to said inlet means of said cylinders and to said compressor and attached to said cooling means of said top for the cooling to said air, when said exhaust gases drive said turbine and said compressor presses at least said air through said common collection chamber and said inlet means into the said cylinders, wherein said cylinder forms a top wall of a partially hollow configuration, while said piston forms a piston top of substantially complementary configuration relatively to said top wall to at least partially and temporarily enter into said configuration to move close towards said top wall and close to said inlet means to obtain a high ratio of compression for a high efficiency and high power operation of said engine, wherein said inlet means consists of two rotary valves which are located in said cylinder head to revolve therein in unison, wherein passage means extend from said inlet valves to said cylinder, wherein said passage means are short and said inlet valves are close to said cylinders to prevent dead space, wherein said passage means port into and through said top wall of said cylinder;

wherein said rotary valves contain cooling passages and flow control ports, wherein cooling spaces are provided close to said common collection chamber and close to the outer walls of said rotary valves, wherein cooling fluid streams are passed through said cooling passages and through said cooling spaces, wherein said turbocharger contains at least two compressor spaces and at least two compressor outlets, wherein one of said outlets is communicated to said cylinder(s) and at least one other of said outlets is communicated to said cooling passages and to said cooling spaces to pass at least one of the flows of said outlets to and through said cylinder(s) and at least another of the flows of said outlets to and through said cooling passages and cooling spaces, and;

wherein said turbocharger has three separated compression chambers with compressor blades therein driven in unison by said turbine, while each of said compression chambers has a separated outlet, wherein one of said outlets supplies air to said cylinder(s), the second of said outlets supplies air to and through said cooling passages of said valve(s) and, wherein the third of said outlets supplies air to and through said cooling chambers in said cylinder head.

2. A reciprocating combustion engine including substantially a structure of a cylinder, a piston reciprocating in said cylinder, a top for closing one end of said cylinder; inlet means and outlet means extending to and from said cylinder for the intake of a combustible gas charge and the expellation of burned exhaust gases, ignition means for the ignition of said gas charge, cooling means applied on said cylinder and on said top, a turbine of a turbocharger communicated to said outlet means and a compressor of said turbo charger communicated to said inlet means, said outlet means formed by slots in the bottom portion of said cylinder and said inlet means are applied in said top, said gas charge including air, said air being pressed through said inlet means into said cylinder by said compressor, at least one second cylinder fastened relatively to said cylinder, a second piston reciprocating in said second cylinder, a common drive means attached to said piston and said second piston for driving said pistons to compression strokes in said cylinders at alternating times, said second cylinder including second outlet means communicated also to said turbine, said top includes second inlet means communicating with said second cylinder and said compressor, wherein a common collection chamber is provided in said top, communicated to said inlet means of said cylinders and to said compressor and attached to said cooling means of said top for the cooling of said air, when said exhaust gases drive said turbine and said compressor presses at least said air through said common collection chamber and said inlet means into the said cylinders, wherein said cylinder forms a top wall of partially hollow configuration, while said piston forms a piston top of substantially complementary configuration relatively to said top wall to at least partially and temporarily enter into said configuration to move close towards said top wall and close to said inlet means to obtain a high ratio of compression for a high efficiency and high power operation of said engine, wherein said inlet means consists of two rotary valves which are located in said cylinder head to revolve therein in unison, wherein passage means extend from said inlet valves to said cylinder, wherein said passages means are short and said inlet valves are close to said cylinders to prevent the presence of dead space, wherein said passage means port into and through said top wall of said cylinder, wherein said rotary valves contain cooling passages and flow control ports, wherein cooling spaces are provided close to said common collection chamber and close to the outer walls of said rotary valves, and, wherein cooling fluid streams are passed through said cooling passages and through said cooling spaces, and;

wherein said turbocharger contains at least two compressor spaces and at least two compressor outlets, wherein one of said outlets is individually communicated to said cylinder(s) and at least one another of said outlet is individually communicated to said cooling passages and to said cooling spaces to pass at least one of the flows of said outlets to and through said cylinder(s) and at least another of the flows of said outlets to and through said cooling passages and cooling spaces.

* * * * *